US008622496B2

(12) United States Patent
Yoshida

(10) Patent No.: US 8,622,496 B2
(45) Date of Patent: Jan. 7, 2014

(54) PRINTING DEVICE AND PRINTING METHOD

(75) Inventor: Seishin Yoshida, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 252 days.

(21) Appl. No.: 13/036,070

(22) Filed: Feb. 28, 2011

(65) Prior Publication Data

US 2011/0221807 A1 Sep. 15, 2011

(30) Foreign Application Priority Data

Mar. 9, 2010 (JP) ..... 2010-051539

(51) Int. Cl.
*B41J 29/38* (2006.01)

(52) U.S. Cl.
USPC ..... 347/9; 347/21

(58) Field of Classification Search
USPC ..... 347/9, 20, 21, 95–102; 106/31.6, 31.13, 106/31.27
IPC ..... B41J 29/38
See application file for complete search history.

(56) References Cited

U.S. PATENT DOCUMENTS

| | | | | |
|---|---|---|---|---|
| 7,407,277 | B2 | 8/2008 | Yoneyama | |
| 7,798,602 | B2 | 9/2010 | Kobayashi et al. | |
| 2002/0154182 | A1 | 10/2002 | Takahashi et al. | |
| 2003/0085974 | A1 * | 5/2003 | Shimomura et al. | 347/101 |
| 2005/0237352 | A1 | 10/2005 | Yoneyama | |
| 2005/0253911 | A1 * | 11/2005 | Spinelli et al. | 347/101 |
| 2008/0213518 | A1 * | 9/2008 | Oyanagi et al. | 428/34.1 |
| 2009/0220695 | A1 * | 9/2009 | Oyanagi et al. | 427/256 |
| 2009/0244137 | A1 | 10/2009 | Kakutani | |
| 2009/0244168 | A1 * | 10/2009 | Kakutani | 347/21 |
| 2010/0009136 | A1 * | 1/2010 | Oyanagi et al. | 428/195.1 |
| 2010/0053267 | A1 | 3/2010 | Seishin | |

FOREIGN PATENT DOCUMENTS

| | | | |
|---|---|---|---|
| JP | 2002-307672 | A | 10/2002 |
| JP | 2007-050555 | A | 3/2007 |
| JP | 2009-234170 | A | 10/2009 |
| JP | 2011-110818 | A | 6/2011 |
| WO | 2005/105452 | A1 | 11/2005 |

* cited by examiner

*Primary Examiner* — Manish S Shah
*Assistant Examiner* — Roger W Pisha, II
(74) *Attorney, Agent, or Firm* — Global IP Counselors, LLP

(57) ABSTRACT

The printing device includes a print head having a specialty gloss ink ejection head for ejecting a specialty gloss ink that creates a special gloss effect and a dye-based color ink ejection head for ejecting a dye-based color ink, and an ejection control unit configured to carry out ejection of the specialty gloss ink from the specialty gloss ink ejection head and ejection of the dye-based color ink from the dye-based color ink ejection head, and to carry out printing of a special gloss area with the specialty gloss ink and printing of a reproduction area onto the special gloss area with the dye-based color ink. The ejection control unit has a first printing mode for carrying out printing of the reproduction area in a main scan that chronologically follows a main scan of the print head in which printing of the special gloss area is carried out.

6 Claims, 8 Drawing Sheets

PRINTING DEVICE AND PRINTING METHOD

CROSS-REFERENCE TO RELATED APPLICATIONS

This application claims priority to Japanese Patent Application No. 2010-051539 filed on Mar. 9, 2010. The entire disclosure of Japanese Patent Application No. 2010-051539 is hereby incorporated herein by reference.

BACKGROUND

1. Technical Field

The present invention relates to a printing device and to a printing method.

2. Related Art

Techniques known in the past for carrying out printing using special inks in addition to color inks include the one disclosed in Japanese Laid-Open Patent Application Publication No. 2007-50555, for example.

This technique is intended to prevent color mixing between white ink and color inks, in instances where white ink is used as a special ink. However, the technique lacks sufficient consideration in relation to printing specifically focused upon the qualities of specialty gloss inks having special gloss effect and upon the qualities of the dye inks used as the color inks.

SUMMARY

With the foregoing in view, it is an object of the present invention to provide a technique adapted both to preserve the effect afforded by a specialty gloss ink, and to preserve the color saturation afforded by dye-based color inks.

The above objects of the invention may be attained at least in part according to the following modes or aspects of the invention.

A printing device according to a first aspect includes a print head and an ejection control unit. The print head has a specialty gloss ink ejection head for ejecting a specialty gloss ink creating a special gloss effect and a dye-based color ink ejection head for ejecting a dye-based color ink. The ejection control unit is configured to carry out ejection of the specialty gloss ink from the specialty gloss ink ejection head and ejection of the dye-based color ink from the dye-based color ink ejection head, and to carry out printing of a special gloss area using the specialty gloss ink and printing of a reproduction area onto the special gloss area using the dye-based color ink. The ejection control unit has a first printing mode for carrying out printing of the reproduction area in a main scan that chronologically follows a main scan of the print head in which printing of the special gloss area is carried out.

According to the first aspect, the reproduction area of dye-based color ink is formed with high color saturation, to the upper layer side of the special gloss area of the specialty gloss ink. Consequently, the reproduction area that is superimposed onto the special gloss area reproduces the color of the dye-based color ink with good color saturation. Moreover, because the color ink of the reproduction area has high transparency due to being dye based, the gloss effect of the special gloss area situated to the lower layer side does not suffer. As a result, it is possible to both preserve the effect afforded by the specialty gloss ink and to preserve the color saturation afforded by the dye-based color ink.

The specialty gloss ink for creating a special gloss effect herein is an ink that creates a special gloss effect on the surface of a printing medium that has undergone printing, such as an effect-producing ink containing a pigment that produces a prescribed effect. Metallic inks, which are one example of such specialty gloss inks, contain metal pigments that produce a metallic effect once fixed onto the surface of a printing medium. Other examples of specialty gloss inks are pearlescent gloss inks containing pigments that have a pearlescent gloss effect once fixed onto the surface of a printing medium, for example, a pigment containing multiple stacked thin layers having pearl color like natural pearl; or lame inks or translucent inks containing pigments that have microscopic irregularities so as to give rise to scattered reflection once fixed onto the surface of a printing medium, to create a lame or translucent effect. Metallic ink, which is one example of the specialty gloss ink herein, refers to an ink having metallic gloss, this metallic gloss being produced by a metal pigment contained in the metallic ink. As metallic inks of this kind, there may be employed oil-based ink compositions containing metal pigments, organic solvents, and resins. In order to effectively produce a metallic gloss effect, it is preferable for the aforementioned metal pigment to have the form of flake-shaped particles; in preferred practice, where the major axis on the plane of the flake-shaped particle is denoted by X, the minor axis by Y, and the thickness by Z, the 50% average particle size R50 of the equivalent circle diameter calculated from the surface area of the X-Y plane of the flake-shaped particle is 0.5-3 μm, and the condition R50/Z>5 is met. It is possible for such metal pigments to be formed, for example, from aluminum or aluminum alloy, or prepared by crushing of a deposited metal film. The metal pigment concentration in the metallic ink may fall between 0.1-10.0 wt %, for example. Of course, metallic inks are not limited to the above formulation, and it is possible for other formulations to be employed appropriately, provided that the formulation gives rise to metallic gloss.

Optionally, the specialty gloss ink is one that when printed onto the surface of a medium has optical properties that are dependent on the reflection angle. One example of these specialty gloss inks, namely metallic inks, is discussed below in terms of the metallic effect from the standpoint of optical properties. Because metallic effect is the result of perception of reflected light, the optical properties thereof are reflection-angle-dependent, and various indices for representing such metallic effect have been proposed. Accordingly, metallic inks that give rise to metallic effect may be defined in terms of such an index. For example, the widely known metallic effect index In1 represented by Equation (1) below may be used. By illuminating a measurement specimen (a printed specimen having metallic effect) from a −45 degree angle and measuring the brightness of reflected light at three different locations as specified in Equation (1), this metallic effect index In1 may be derived from the relationship of brightness observed at these three locations. Consequently, with this metallic effect index In1, metallic inks may be defined in the same manner as the aforementioned metal pigments for producing metallic effect.

Equation (1)

$$In1 = \frac{2.69(L_1^* - L_3^*)^{1.11}}{L_2^{*0.86}} \quad (1)$$

$L_1$*: brightness at 30 degree light reception angle (irradiation angle −45 degrees)

$L_2$*: brightness at 0 degree light reception angle (irradiation angle −45 degrees)

$L_3$*: brightness at −65 degree light reception angle (irradiation angle −45 degrees)

Other indices of metallic effect may be employed instead, such as metallic effect index In2 represented by Equation (2) below or the metallic effect index In3 represented by Equation (3) below, using brightness at the three locations specified in Equation (1).

Equation (2)

$$In2 = \frac{3(L_1^* - L_3^*)}{L_2^*} \quad (2)$$

Equation (3)

$$In3 = L_1^* - L_3^* \quad ...(3)$$

Because all of the index values indicated by the above equations are derived as numerical values dependent on reflection angle, it is possible for specialty gloss inks to be specified in terms of these index values.

The dye-based color inks herein are inks adapted to penetrate into the ink absorption layer of a printing medium and reproduce color in the ink absorption layer. These dye-based color inks are inks that contain dyes as organic coloring matter, and that reproduce the color of the organic coloring matter contained therein. The dyes may be either natural dyes or synthetic dyes. Examples of colors used in color printing and examples of dye based inks of those colors are given below.

For example, to describe an example using light cyan and light magenta in addition to the usual four colors of ink of cyan, magenta, yellow, and black, the cyan ink is one obtained by dissolving Direct Blue 99, an example of a dye that produces cyan color, in a solvent of for example, a mixture of diethylene glycol for viscosity adjustment purposes and water. The light cyan ink is one obtained by dissolving this dye that produces cyan color dye in the aforementioned solvent, but at a lower concentration of the dye. The magenta ink is one obtained by dissolving Acid Red 289, an example of a dye that produces magenta color, in the aforementioned solvent. The light magenta ink is one obtained by dissolving this dye that produces magenta color dye in the aforementioned solvent, but at a lower concentration of the dye. The yellow ink is one obtained by dissolving Direct Yellow 86, an example of a dye that produces yellow color, in the aforementioned solvent. The black ink is one obtained by dissolving Hood Black 2, an example of a dye that produces black color, in the aforementioned solvent. These dye-based color inks may undergo viscosity adjustments after having respectively adjusted the dye concentration, and the concentrations of the diethylene glycol for viscosity adjustment purposes and the water.

In the printing device according to a second aspect, the ejection control unit preferably further has a second printing mode whereby printing of the special gloss area by ejection of the specialty gloss ink from the specialty gloss ink ejection head and printing of the reproduction area by ejection of the dye-based color ink from the dye-based color ink ejection head are carried out simultaneously during one pass of the print head along a main scanning direction.

According to the second aspect, in special gloss areas that overlap reproduction areas, the dye-based color ink penetrates to the lower layer side of the special gloss area and reproduces color. If a translucent printing medium that has been printed is observed looking through the medium from the obverse face side of the printed face, the reproduction areas of color ink that have penetrated into the printing medium appear to overlap the special gloss areas of printing with specialty gloss ink. In reproduction areas that overlap special gloss areas of printing with specialty gloss ink (hereinafter, these areas are designated as metallic color areas for convenience), the color of the dye-based color ink is reproduced with good saturation; and because the dye-based color ink is highly translucent, the effect of the special gloss area situated to the lower layer side does not suffer. As a result, it is possible both to preserve the gloss effect (prescribed effect) and to preserve the color saturation of color printing in an image printed concomitantly with specialty gloss ink and dye-based color ink. Moreover, in printed matter obtained in this manner, the translucent printing medium has the function of protecting the printed area, thereby contributing to maintaining print quality. Further, because printing of the special gloss areas and printing of the reproduction areas are carried out simultaneously, less time is required for the printing process.

The present invention may be reduced to practice in various modes. Examples of such modes include a printing method and device; a printing system; an integrated circuit or computer program for accomplishing the functions of the method or device; a recording medium having the computer program recorded thereon, or the like.

BRIEF DESCRIPTION OF THE DRAWINGS

Referring now to the attached drawings which form a part of this original disclosure.

DETAILED DESCRIPTION OF EXEMPLARY EMBODIMENTS

The mode of working the invention is described below on the basis of preferred embodiments in the following order: A. Overview of Embodiment; B. Device Configuration; C. Embodiment; and D. Modified Examples.

A. Overview of Embodiment

Figure 1:
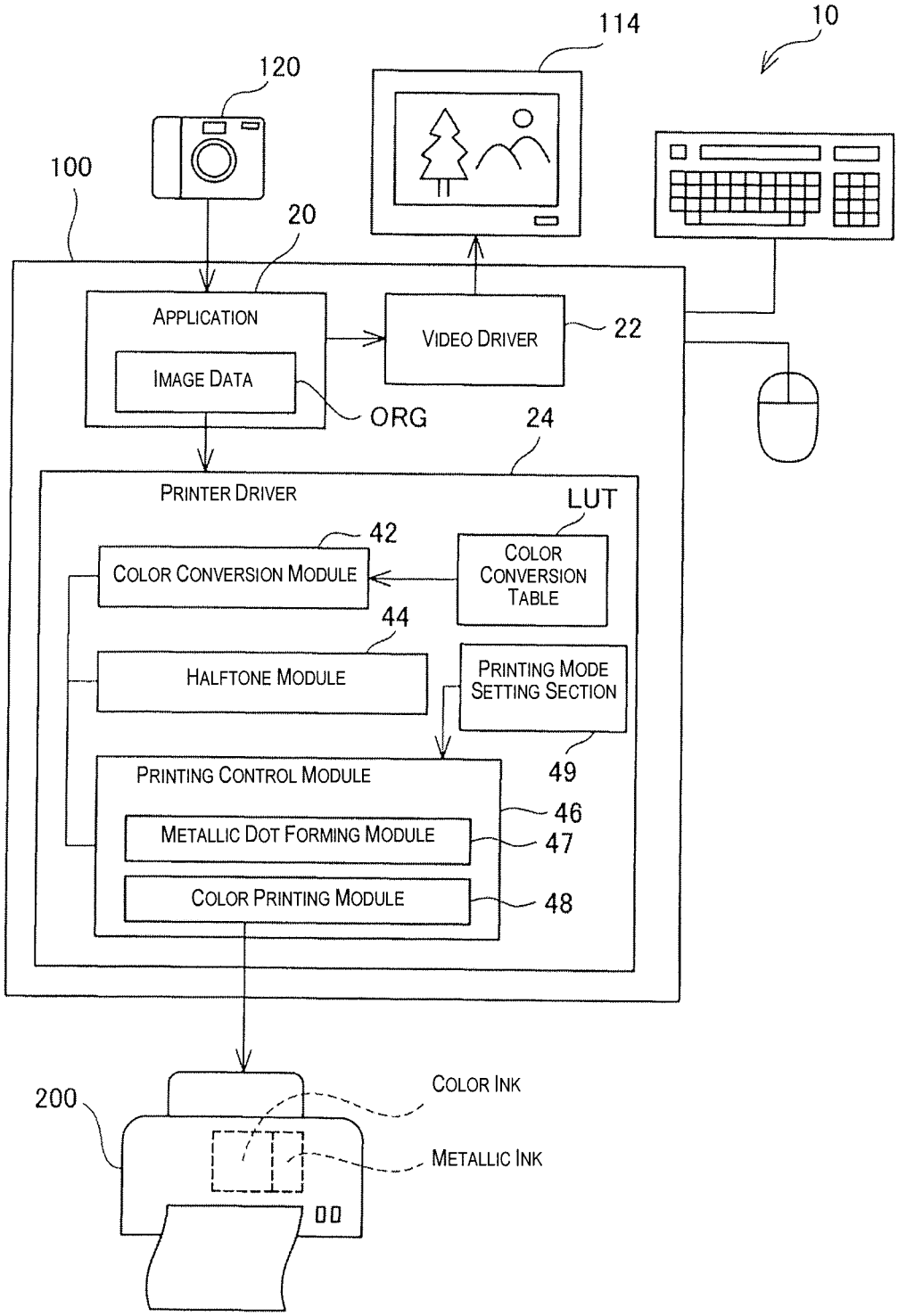
FIG. 1 is a simplified configuration diagram of a printing system 10 according to an embodiment of the invention.

FIG. 1 is a simplified configuration diagram of a printing system 10 according to an embodiment of the invention. As shown in the drawing, the printing system 10 of the present embodiment includes a computer 100 provided as a printing control device (ejection control device), and a printer 200 for actually printing the images under the control of the computer 100. The printing system 10 taken as a whole functions as a printing device in the broad sense.

The printer 200 of the present embodiment is provided, as the color inks, with cyan ink, magenta ink, yellow ink, and black ink; and is additionally provided with metallic ink of metallic effect owing to a metal pigment contained therein. In the present embodiment, the term "color ink" is used to include black ink as well.

In the present embodiment, an oil-based ink composition containing a metal pigment, an organic solvent, and a resin is used as the metallic ink. With regard to the metal pigment contained therein, pigments having the following specifications may be contained. For example, a metal pigment of flake-shaped particle form, wherein if the major axis on the plane of the flake-shaped particle is denoted by X, the minor axis by Y, and the thickness by Z, the 50% average particle size R50 of the equivalent circle diameter calculated from the surface area of the X-Y plane of the flake-shaped particle is 0.5 to 3 μm, and meeting the condition R50/Z>5, is employed. In this case, it is possible to use metal pigments formed from aluminum or aluminum alloy, or metal pigments prepared by crushing of a deposited metal film. In the present embodiment, a metal pigment formed from aluminum is used. The metal pigment concentration of the metallic ink may fall between 0.1-10.0 wt %, for example; in the present embodiment, one having a concentration of 1.5 wt % is used.

The color inks are dye-based color inks containing as the dyes organic coloring matter for reproducing the colors listed above. In the present embodiment, dye-based color inks of the four colors cyan, magenta, yellow, and black are used. The cyan ink contains 3.6 weight percent of Direct Blue 99 which is a dye of cyan color, the dye being dissolved in a solvent mixture of 30 weight percent of diethylene glycol for viscosity adjustment purposes, 1 weight percent of SURFYNOL 465, and 65.4 weight percent of water. The magenta ink contains 2.8 weight percent of Acid Red 289 which is a dye of magenta color, the dye being dissolved in a solvent mixture of 20 weight percent of diethylene glycol for viscosity adjustment purposes, 1 weight percent of SURFYNOL 465, and 76.2 weight percent of water.

The yellow ink contains 1.8 weight percent of Direct Yellow 86 which is a dye of yellow color, the dye being dissolved in a solvent mixture of 30 weight percent of diethylene glycol for viscosity adjustment purposes, 1 weight percent of SURFYNOL 465, and 67.2 weight percent of water. The black ink contains 4.8 weight percent of Hood Black 2 which is a dye of black color, the dye being dissolved in a solvent mixture of 35 weight percent of diethylene glycol for viscosity adjustment purposes, 1 weight percent of SURFYNOL 465, and 69.2 weight percent of water. Each ink is adjusted to viscosity of about 3 (mPa·s), for example, to avoid any difficulty in ejection from the ejection head.

Where so-called light color inks are to be used in addition to the color inks listed above, the light cyan ink may be one containing Direct Blue 99, a dye of cyan color, in a reduced amount of 0.9 weight percent equivalent to one-fourth that of the cyan ink, the dye being dissolved in a solvent mixture of 35 weight percent of diethylene glycol for viscosity adjustment purposes, 1 weight percent of SURFYNOL 465, and 63.1 weight percent of water. The light magenta ink may be one containing Acid Red, a dye of magenta color, in a reduced amount of 0.7 weight percent equivalent to one-fourth that of the magenta ink, the dye being dissolved in a solvent mixture of 25 weight percent of diethylene glycol for viscosity adjustment purposes, 1 weight percent of SURFYNOL 465, and 73.3 weight percent of water.

The computer 100 has a prescribed operating system installed thereon, and an application program 20 runs on this operating system. The operating system incorporates a video driver 22 and a printer driver 24. The application program 20 is designed, for example, to input image data ORG from a digital camera 120 through a peripheral interface 108. Via the video driver 22, the application program 20 brings up a display of the image represented by the image data ORG on a display 114. Via the printer driver 24, the application program 20 outputs the image data ORG to the printer 200. The image data ORG input to the application program 20 from the digital camera 120 is data composed of the three color components red (R), green (G), and blue (B).

The application program 20 of the present embodiment is able to designate, for any areas in the image data ORG, areas composed of the R, G, B color components (herein termed "color development areas") and areas printed with metallic ink herein termed "metallic areas"). Metallic areas and color development areas partially overlap, and in the overlapping areas, the metallic gloss of the metal pigment in the metallic ink constitutes the background color, with a color image formed thereon. That is, these overlapping areas constitute metallic/color reproduction areas. Alternatively, these may be constituted as metallic areas using metallic ink alone (singularly metallic areas). When designating metallic areas in this way, the areas in question may be designated in advance; or, for example, the application program 20 may be programmed to designate printing areas containing graphics with specific contours as metallic areas, or the application program 20 may be programmed to designate printing areas with specific color as metallic areas.

In the printer driver 24 there is provided a color conversion module 42, a halftoning module 44, and a printing control module 46. Of these, the printing control module 46 includes a metallic dot forming module 47, a color printing module 48, and a printing mode setting section 49.

For color development areas in image data ORG, the color conversion module 42, making reference to a color conversion table LUT prepared in advance, converts the R, G, and B color components to color components that can be reproduced by the printer 200 (the colors cyan (C), magenta (M), yellow (Y), and black (K)).

The halftoning module 44 performs a halftoning process whereby tones of the image data having undergone color conversion by the color conversion module 42 are represented by distributions of dots. In the present embodiment, the widely known systematic dither method is employed as this halftoning process. Other halftoning techniques besides the dither method, such as the error diffusion method or density pattern method, may be employed as the halftoning process.

The printing control module 46 resequences the halftone-processed image data into the proper order for transfer to the printer 200 and outputs the data as print data to the printer 200. The printing control module 46 also performs control of the printer 200 by outputting various commands, such as a Start Print command or Stop Print command, to the printer 200.

In the present embodiment, the printing control module 46 includes a metallic dot forming module 47 and a color printing module 48. The metallic dot forming module 47 forms metallic dots of prescribed size in metallic areas specified by the application program 20. In the present embodiment, for example, the distributed amount of metallic pigment per unit surface area in metallic areas can be stipulated by varying the dot size of the metallic dots. For example, the distributed amount of metallic pigment may be increased to enhance the metallic effect, or the distributed amount of metallic pigment may be decreased to diminish the metallic effect. The color printing module 48 carries out dot formation with color ink of each color for the halftone-processed image, i.e., the image of the color development areas.

Prior to initiation of the printing process, the printing mode setting section 49 receives an instruction from the user indicating whether to execute a first printing mode or to execute a second printing mode, and sets the printing mode on the basis of the received instruction. Here, the first printing mode is a mode used when printing a non-translucent printing medium, whereas the second printing mode is a mode used when printing a translucent printing medium.

B. Device Configuration

Figure 2:
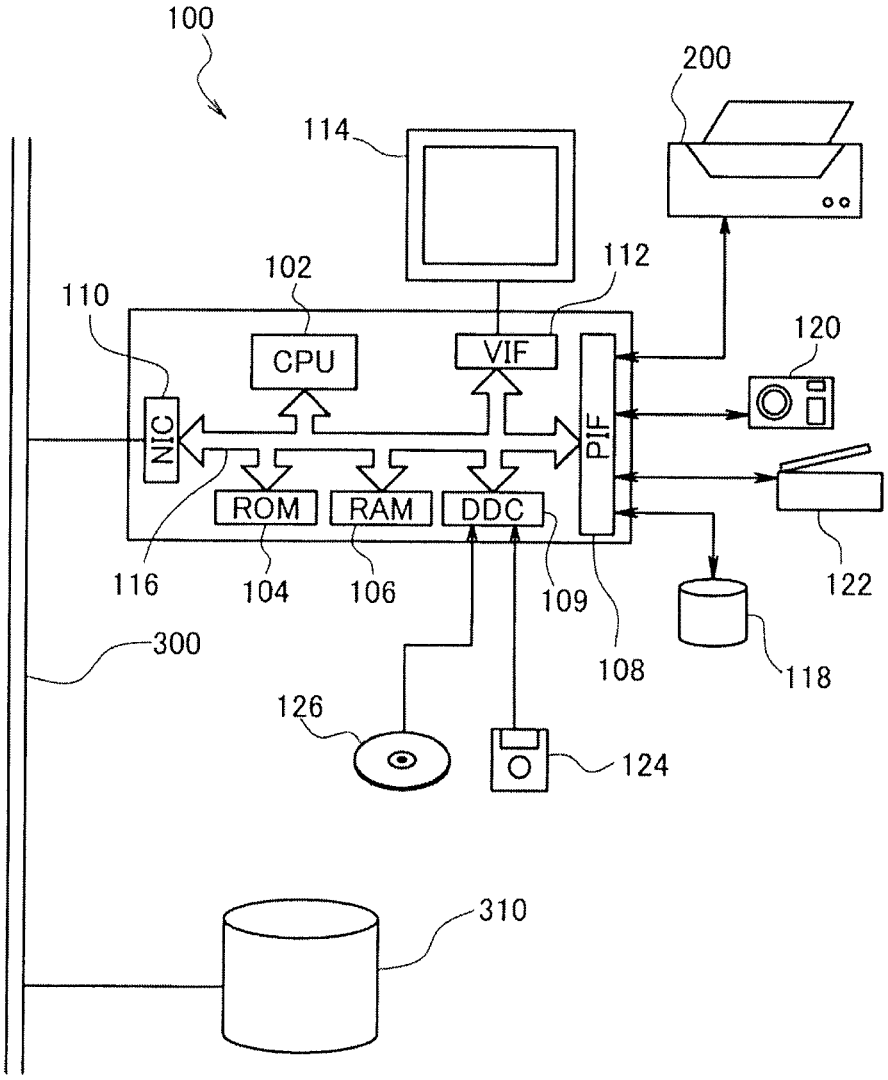
FIG. 2 is a configuration diagram of a computer 100 provided as a printing control device.

FIG. 2 is a configuration diagram of a computer 100 provided as a printing control device. The computer 100 is a computer of known design centered on a CPU 102 and including a ROM 104, a RAM 106, and so on, these components being interconnected by a bus 116.

To the computer 100 there are connected a disk controller (DDC) 109 for reading data from a flexible disk 124, a compact disc 126, or the like; a peripheral interface 108 for data transfer to and from peripheral devices; and a video interface (VIF) 112 for driving a display 114. The printer 200 and a hard disk 118 are connected to the peripheral interface 108.

Where a digital camera 120 or a color scanner 122 is connected to the peripheral interface 108, it is possible to perform image processing of an image retrieved from the digital camera 120 or the color scanner 122. Where a network interface card (NIC) 110 is installed, the computer 100 is able to connect to a communications circuit 300 and retrieve data stored in a storage device 310 that is also connected to the communications circuit. Once the computer 100 has retrieved the data to be printed, the printer 200 is controlled through operation of the printer driver 24 described above to carry out printing of this print data.

Figure 3:
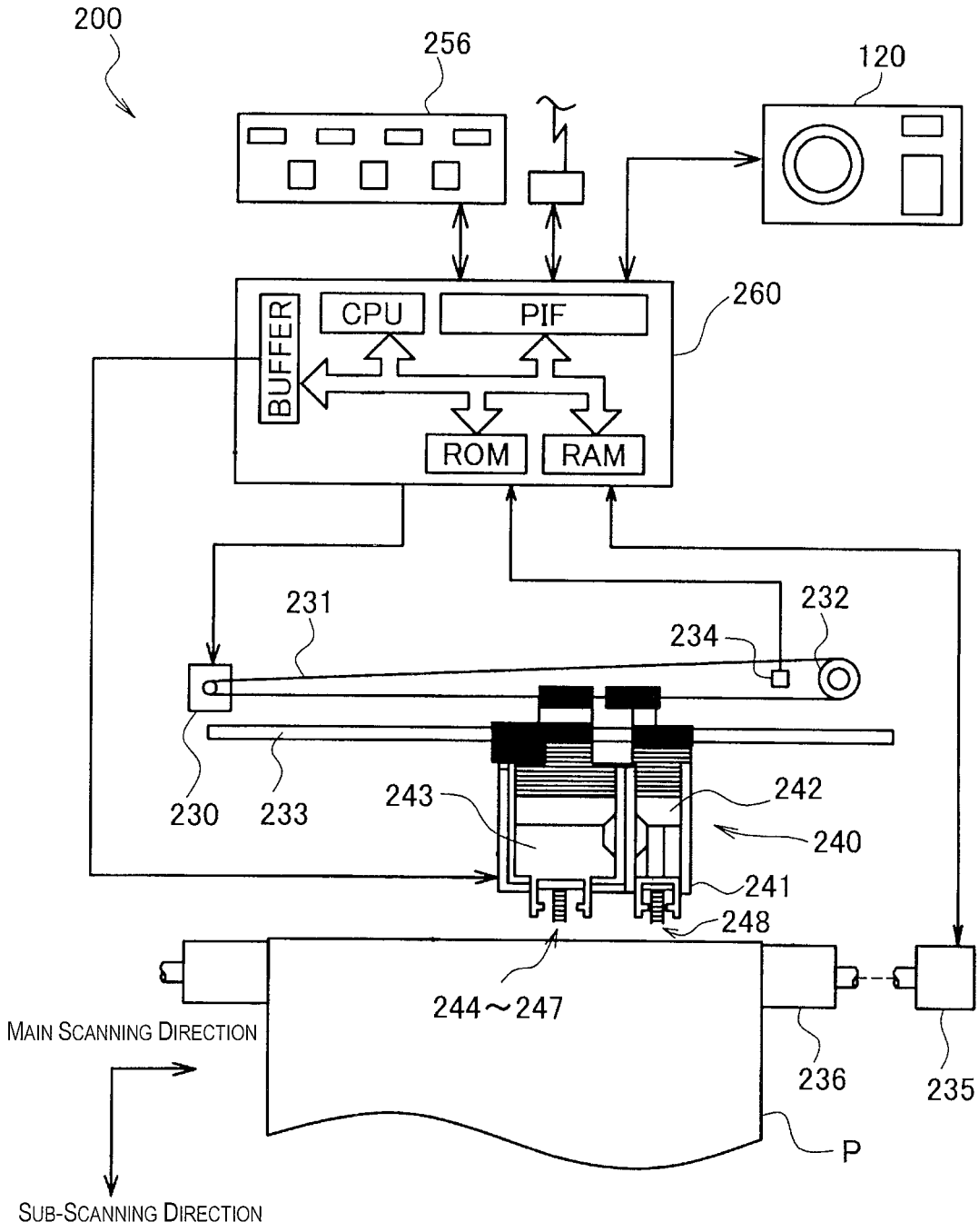
FIG. 3 is a block diagram depicting a simplified configuration of a printer 200.

The description turns next to the configuration of the printer 200. FIG. 3 is a block diagram depicting a simplified configuration of the printer 200. As shown in FIG. 3, the printer 200 includes a mechanism for advancing a printing medium P by a feed motor 235, a mechanism for reciprocating a carriage 240 in the axial direction of a platen 236 by a carriage motor 230, a mechanism for driving a print head 241 installed on the carriage 240 to eject ink and form dots, and a control circuit 260 for exchange of signals with the feed motor 235, the carriage motor 230, the print head 241, and a control panel 256.

The mechanism for reciprocating the carriage 240 in the axial direction of the platen 236 includes a slide rail 233 suspended parallel to the axis of the platen and adapted to slidably retain the carriage 240, a pulley 232 linked with the carriage motor 230 via an endless drive belt 231, and a position detection sensor 234 for detecting the home position of the carriage 240.

On the carriage 240 there is installed a color ink cartridge 243 containing the respective color inks, i.e., cyan ink (C), magenta ink (M), yellow ink (Y), and black ink (K). A metallic ink cartridge 242 containing metallic ink (S) is installed on the carriage 240 as well. On the print head 241 at the bottom of the carriage 240 there are formed a total of five ink ejection heads 244 to 248 corresponding to each of the colors. When these ink cartridges 242, 243 are installed on the carriage 240 from above, it is possible for ink to be supplied from the cartridges to the ink ejection heads 244 to 248.

Figure 4:
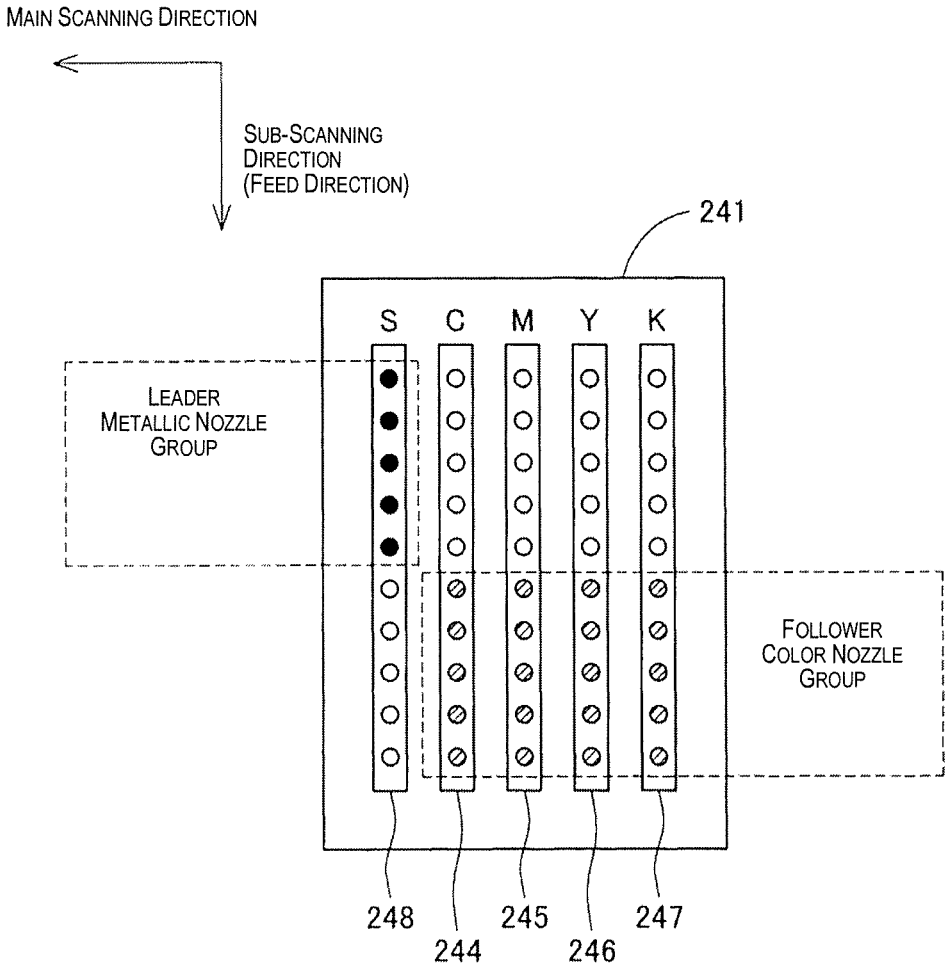
FIG. 4 is an illustration of a simplified depiction of nozzle positioning in ink ejection heads that are part of a print head 241.

The print head 241 is now described. FIG. 4 is an illustration of a simplified depiction of nozzle positioning on the ink ejection heads that are part of the print head 241. As shown in the drawing, in the present embodiment, for each of the colors metallic ink (S), cyan ink (C), magenta ink (M), yellow ink (Y), and black ink (K), there are respectively provided ten nozzles arrayed in the sub-scanning direction on the bottom face of the print head 241. The nozzles are positioned at 2-dot intervals in the sub-scanning direction. In the drawing, because the downward direction indicates the sub-scanning direction (the paper fee direction), during printing, the printing medium P first passes by the nozzles shown uppermost in the drawing. In the drawing, nozzles shown with black circles represent nozzles for ejecting metallic ink in the first printing mode, discussed later, and nozzles shown with crosshatching represent nozzles for ejecting color ink. The other nozzles represent nozzles that are not used.

As shown in FIG. 4, in the first printing mode to be discussed later, of the ten nozzles of the ink ejection head 248 for metallic ink, the five nozzles that the printing medium P first passes by are used during actual printing, whereas the remaining five are not used. Of the ten nozzles of each of the ink ejection heads 244 to 247 constituting the nozzle rows of the color inks (C, M, Y, K), the five nozzles that the printing medium P first passes by are not used, and the remaining five are used. Herein, when necessary to do so, nozzles that eject metallic ink are referred to as the leader metallic ink nozzle group, and nozzles that eject color inks are referred to as the follower color nozzle group.

Each of the nozzles shown in FIG. 4 incorporates a piezo element. It is widely known that piezo elements are elements that experience deformation of their crystal structure through application of an electrical voltage, and that are able to perform electrical-mechanical energy conversions in an extremely rapid manner. In the present embodiment, a prescribed voltage signal (drive signal) is applied to the piezo elements, thereby causing one side wall of the ink passage of the nozzle to deform and eject an ink droplet from the nozzle. While according to the present embodiment, ink is ejected using piezo elements in the above manner, optionally, there could instead be employed a system of ejecting ink by generating bubbles inside the nozzles.

The control circuit 260 of the printer 200 shown in FIG. 3 includes a CPU and a ROM, a RAM, and a PIF (peripheral interface), these components being interconnected by a bus, the control circuit 260 controlling the main scanning operation and sub-scanning operation of the carriage 240 through control of operation of the carriage motor 230 and the feed motor 235. When print data output from the computer 100 is received via the PIF, it is possible to drive the ink ejection heads 244 to 248 by presenting the heads with a drive signal appropriate to the print data, in tandem with main scanning or sub-scanning of the carriage 240.

In the printer 200 having the hardware configuration described above, the ink ejection heads 244 to 247 of each color undergo reciprocating motion in the main scanning direction relative to the printing medium P through driving of the carriage motor 230, and the printing medium P undergoes motion in the sub-scanning direction through driving of the feed motor 235. Through driving of the nozzles at appropriate timing based on the print data in tandem with reciprocating motion of the carriage 240 (main scanning) and feeding of the printing medium (sub-scanning), the control circuit 260 forms ink dots of the appropriate color at the appropriate locations on the printing medium P. Through this arrangement, it is possible for the printer 200 to carry out color image printing on the printing medium P, as well as to form color printing image areas that overlap metallic areas (metallic/color reproduction areas).

Although the printer 200 of the present embodiment is described as being an inkjet printer that ejects ink droplets towards the printing medium P in order to form dots thereon, the printer may be one that forms dots by any method. For example, the present invention may be favorably adapted to a printer that forms dots by depositing toner particles each color onto a printing medium electrostatically, rather than by ejecting ink droplets.

C. Embodiment

(C1) First Printing Mode (Used when Printing a Non-Translucent Printing Medium P)

Figure 5:
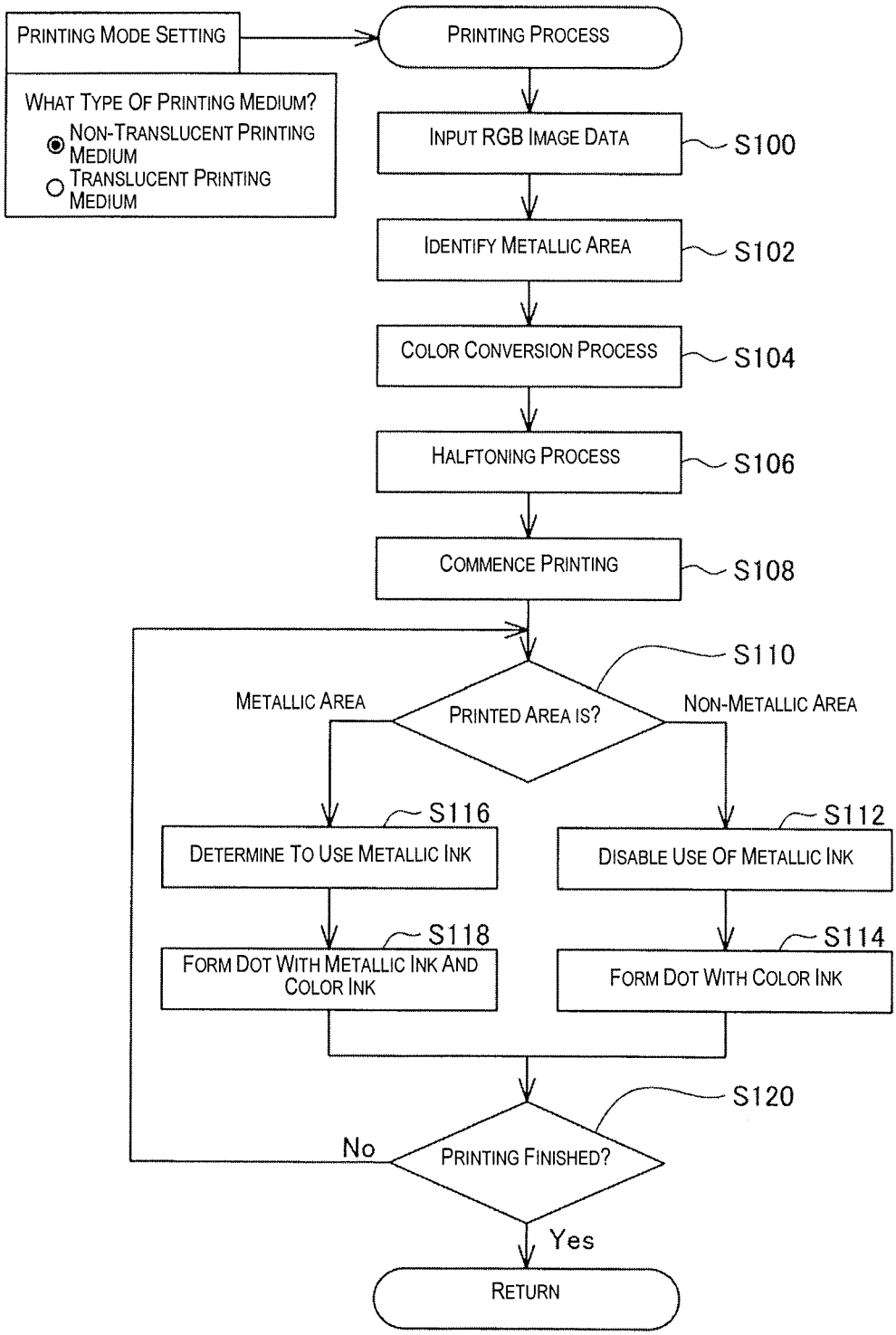
FIG. 5 is a flowchart of a printing process.
Figure 6A:
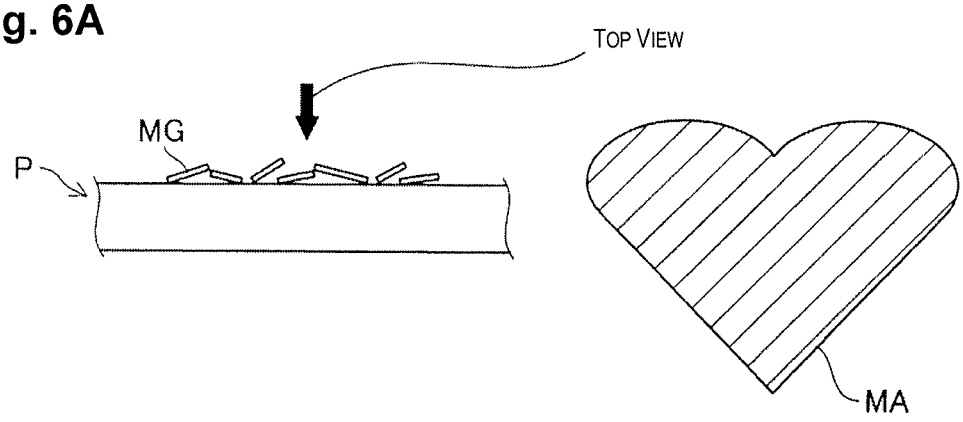
FIGS. 6A to 6C are illustrations schematically showing conditions during printing by joint use of metallic ink and dye-based color inks in a printing process.
Figure 6B:
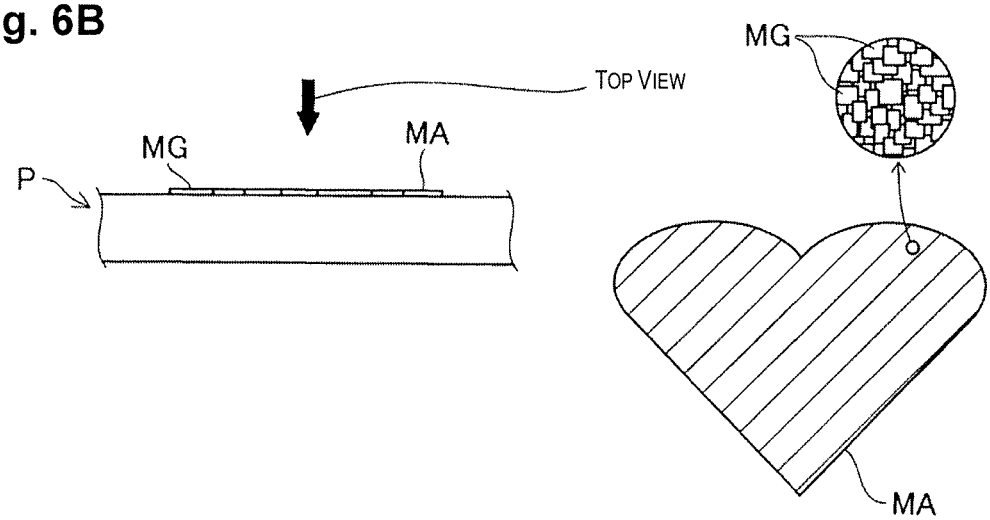
Figure 6C:
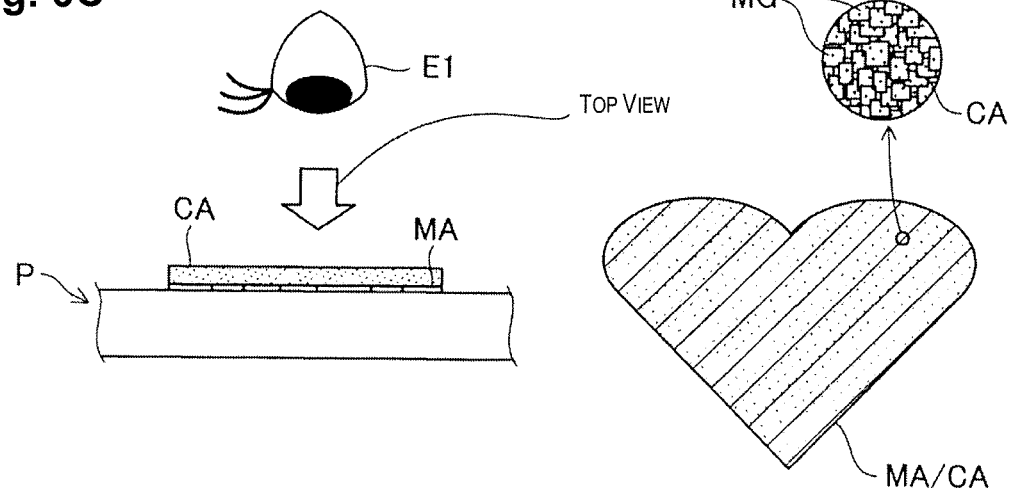

FIG. 5 is a flowchart of the printing process; and FIGS. 6A to 6C are illustrations schematically showing conditions during printing by joint use of metallic ink and dye-based color inks in this printing process. According to the present embodiment, the computer 100 carries out a process to identify metallic areas where metallic ink is used; and for areas other than the metallic areas, restricts the use of metallic ink so that printing takes place with color inks only. Prior to commencing the printing process, the printing mode setting section 49 receives a user instruction to either execute the first printing mode or execute the second printing mode, and sets the printing mode based on the received instruction. The following description relates to the process in an instance where the first printing mode (mode for printing a non-translucent printing medium P) has been set.

When the printing process commences, the computer 100 first inputs data in RGB format (Step S100). Once the data is input, the computer 100 identifies the metallic areas that were designated by the application program 20 (Step S102). To describe this identification process using FIGS. 6A to 6C, the computer 100, in accordance with a program designated by the application program 20, identifies a graphics area having a heart shape as depicted in FIGS. 6A to 6C, for example, as being a metallic area. Other areas to be printed with prescribed color, inclusive of the shape thereof, may be identified as metallic areas by the application program 20. For example, if a printed image includes the sun or stars, the sun or stars in the image may be differentiated through image analysis of shape, color, etc., and these differentiated areas then identified as metallic areas.

Once the metallic areas are identified, the computer 100 next uses the color conversion module 42 to convert the RGB format image data that was input in Step S100 to CMYK format image data (Step S104). Once the CMYK format image data is obtained, the computer 100 carries out a halftoning process using the halftoning module 44, and generates data that is transferable to the printer 200 (Step S106).

Once the halftoning process has finished, the computer 100 uses the printing control module 46 to control the printer 200, and commences printing (Step S108).

Once printing has commenced, the computer 100 compares the metallic areas that were identified in Step S102 with the locations of current dots that were assigned through dot formation for producing the printed image, in order to decide whether a current dot targeted for printing lies in a metallic area or a non-metallic area (i.e., a color-only reproduction area using solely color ink) (Step S110). If, as a result of this decision, it is decided that the current dot targeted for printing lies in a non-metallic area, the computer 100 disables the use of metallic ink for the current dot targeted for printing (Step S112), and executes printing through formation of a dot of color ink only (Step S114).

On the other hand, if it is decided that the current dot targeted for printing lies in a metallic area, the computer 100 determines to use metallic ink for the current dot targeted for printing (Step S116), and forms the dot using metallic ink and color ink (Step S118). Specifically, for the current dot targeted for printing, a dot of metallic ink of a given density is formed and a metallic area is printed by ejecting the metallic ink first; and thereafter color ink is ejected to print a color reproduction area with color ink over the metallic area. By this process, there is formed a metallic/color reproduction area in which the color reproduction area overlaps the metallic area.

Once formation of the current dot targeted for printing and ink ejection have been completed in the aforementioned Step S114 or Step S118, the computer 100 decides whether printing of all of the image data has finished (Step S120). If printing of all of the image data has not yet finished, the computer 100 returns the process to Step S110, and then resumes formation of another dot. If, on the other hand, printing of all of the image data has finished, the printing process terminates.

Conditions of printing according to the aforementioned Step S118 in the case of printing by repeated dot formation and ejection thereof in the above manner for all of the image data is described in detail with reference to FIGS. 6A to 6C.

As shown in FIG. 6A, in the present embodiment, a metallic area MA having a heart shape is identified in the process of Step S102. Accordingly, in Step S118, first, the heart-shaped metallic area MA is printed onto the printing medium P with metallic ink through ink ejection from the ink ejection head 248 of the print head 241 by the metallic dot forming module 47 of the printing control module 46. In this case, as described in FIG. 4, because the leader metallic ink nozzle group is the set of nozzles that the printing medium P first passes by, physical printing of the heart-shaped metallic area MA with metallic ink takes place first as well.

The metal pigment MG contained in the metallic ink does not form a regular arrangement at the moment of its arrival at the printing medium P (FIG. 6A). Thereafter, the metal pigment MG orients into a regular arrangement in the metallic area MA, producing a metallic effect (FIG. 6B).

Once printing of the metallic area MA with metallic ink has finished, or more specifically, when printing of a metallic area MA in a localized area extending in the main scanning/sub-scanning direction has finished, a heart-shaped color reproduction area CA is printed with color inks of the respective colors in the printed metallic area MA in question, through ejection of the ink in question by the follower color nozzle group of nozzle rows of the print head 241 (FIG. 6C). In this case, the color reproduction area CA is formed overlapping the previously printed metallic area MA, but because the metallic pigment MG has oriented into a regular arrangement, the dye-based color inks do not readily penetrate down to the metallic pigment MG. Accordingly, as shown in side view in FIG. 6C, the dye-based color inks undergo fixation at the upper side of the metallic area MA, and a heart-shaped color reproduction area CA similar to the metallic area MA is formed with high color saturation over the metallic area MA. In this case, the color reproduction area CA may differ in shape from the metallic area MA, for example, a partial area of the metallic area MA, or an area including the metallic area MA.

In non-metallic areas on the other hand, printing with metallic ink in Step S112 is not carried out. Therefore, printing in Step S114 is carried out with color ink only, whereby a color reproduction area only is printed with color ink that has penetrated into the ink absorption layer PIK.

Through the printing process of the embodiment described above, the printing system 10 carries out metallic area printing using metallic ink and color reproduction area printing using dye-based color inks of the colors cyan (C), magenta (M), yellow (Y), and black (K) on the printing medium P. During this procedure, the printing system 10 carries out printing of the color reproduction area CA subsequent to printing of the metallic area MA. Because printing of the metallic area MA takes place first, metallic areas of high smoothness and good metallic gloss may be produced consistently. In the printing system 10, by carrying out printing in this sequence, the color reproduction area CA of dye-based color ink may be formed with high color saturation over the metallic area MA of metallic ink as shown in FIGS. 6A to 6C.

Therefore, if the printed result obtained on a translucent printing medium P with the printing system 10 of the present embodiment is viewed from the ink-imprinted face (E1), the color reproduction area CA of dye-based color ink is seen to overlap the metallic area MA of metallic ink. The color reproduction area CA overlapping the metallic area MA printed with metallic ink reproduces the color of the dye-based color ink with good color saturation. Moreover, because the color ink of the color reproduction area CA is dye based and therefore highly translucent, the metallic effect of the metallic area MA located at the lower layer side does not suffer. As a result, according to the printing system 10 of the present embodiment, it is possible both to preserve the metallic effect and to preserve the color saturation of color printing in an image that is printed using metallic ink and dye-based color ink jointly.

Moreover, with the printing system 10 of the present embodiment, it is possible both to preserve the metallic effect and to preserve color saturation of color printing in an image that is printed using metallic ink and dye-based color ink jointly using the inkjet system printing method which enjoys widespread use as a printing method.

(C2) Second Printing Mode (Used when Printing a Translucent Printing Medium P2)

The description turns next to a second printing mode that is used when printing a translucent printing medium P2.

Figure 7:
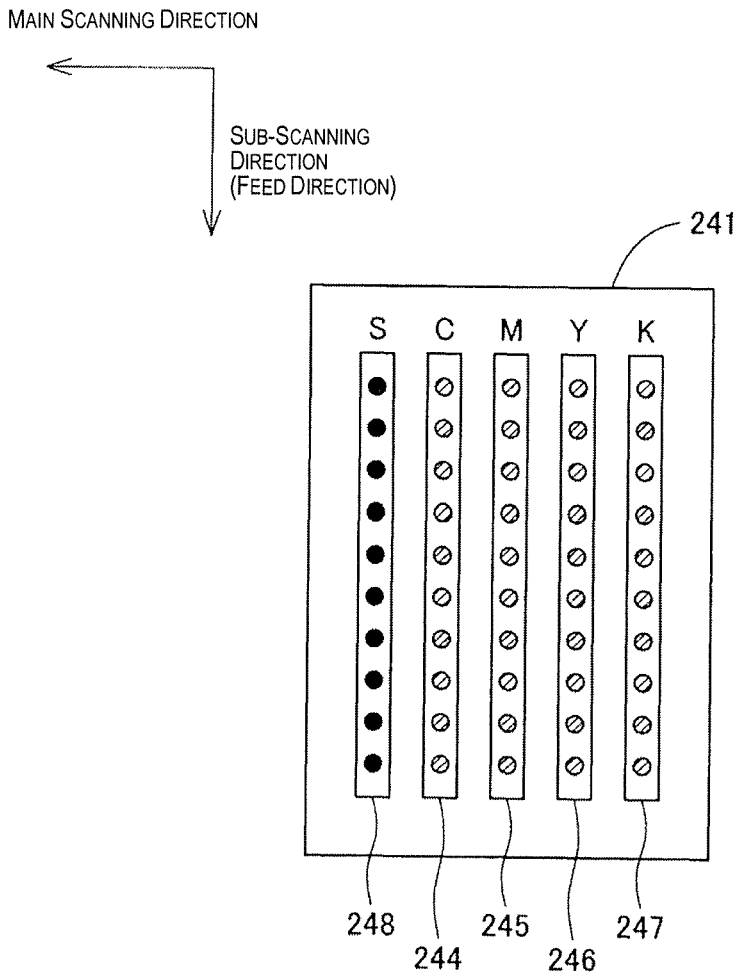
FIG. 7 is an illustration depicting nozzle usage in a second printing mode.

FIG. 7 is an illustration depicting nozzle usage in a second printing mode. In the drawing, nozzles shown with black circles represent nozzles for ejecting metallic ink in the first printing mode, discussed later, and nozzles shown with cross-hatching represent nozzles for ejecting color ink. Specifically, when printing of a metallic/color area is carried out, the metallic ink and the dye-based color ink are ejected simultaneously during a single pass of the print head 241 in the main scanning direction.

Figure 8A:
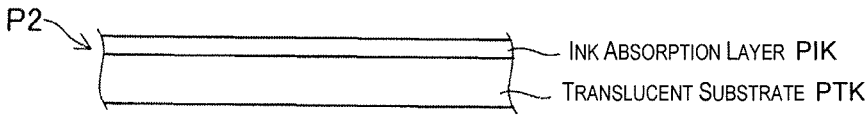
FIGS. 8A to 8C are illustrations depicting printing on a translucent printing medium P2.
Figure 8B:
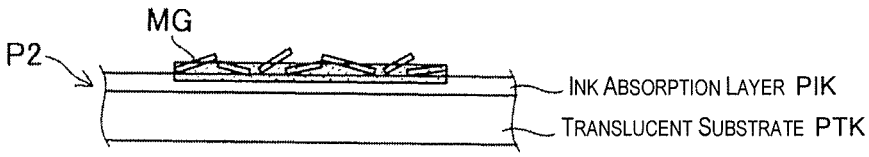
Figure 8C:
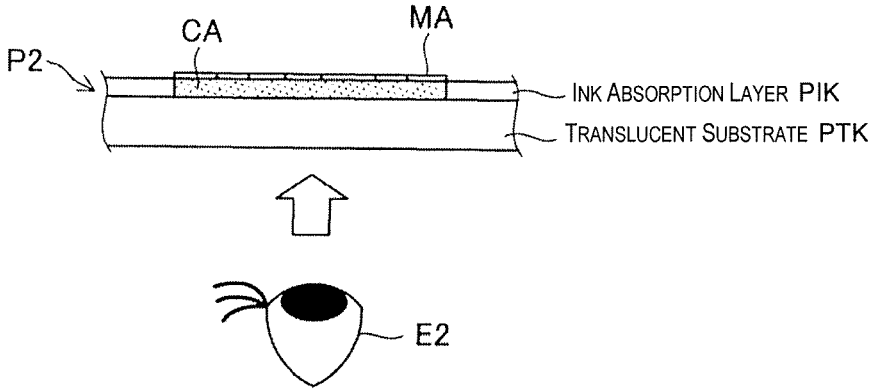

FIGS. 8A to 8C are illustrations depicting printing on a translucent printing medium P2. First, the printing medium P2 is described. As shown in FIG. 8A, the printing medium P2 targeted for printing in the present embodiment includes a translucent substrate PTK of translucent polyethylene terephthalate (PET) or the like, and an ink absorption layer PIK already formed on the substrate surface. Because this ink absorption layer PIK is also translucent, the printing medium P2 is a medium having overall transparency. In this case, the printing medium P2, oriented with the ink absorption layer PIK side as the printing face, is advanced to the platen 236 and travels in the sub-scanning direction.

The ink absorption layer PIK formed on the translucent substrate PTK has the action of fixing the dye of the dye-based color inks of the aforementioned colors when penetrated by the ink, and reproducing the color of the particular dye. For example, for the ink absorption layer PIK, an absorbent layer-forming material that is readily penetrated by dye-based color inks and that readily fixes dyes, such as polyvinyl alcohol or the like, is used to form a layer having a thickness of up to about 50 μm on the substrate surface of the translucent substrate PTK, which reproduces the color of the color ink in question through fixation of the dye contained in a penetrating color ink of any of the aforementioned colors. In this case, if there is color mixing of color inks, the color resulting from the color mixing is reproduced.

In Step S118, through metallic ink ejection from the ink ejection head 248 of the print head 241 by the metallic dot forming module 47 of the printing control module 46, a metallic area MA of the ink in question is printed onto the ink absorption layer PIK side of the printing medium P2. In this case, as discussed in FIG. 7, printing of the color reproduction area CA of dye-based color ink is carried out simultaneously during a single pass of the print head 241 along the main scanning direction.

Because the metallic ink is an oil base ink composition containing a metal pigment as described previously, the ink does not penetrate into the ink absorption layer PIK but instead accumulates on the absorbent layer surface to form the printed metallic area MA. However, just after the moment of arrival at the printing medium P2, the metal pigment MG contained therein has not yet oriented into a regular arrangement. Consequently, tiny gaps are present between adjacent metal pigment MG particles or overlapped metal pigment MG particles, and therefore the color ink which has been ejected during the same main scan is able to penetrate into the ink absorption layer PIK through these tiny gaps.

Consequently, as shown in side view in FIG. 8C, the dye-based color ink penetrates into the ink absorption layer PIK to the lower side of the metallic area MA and the dye becomes fixed thereby, whereby a heart-shaped color reproduction area CA similar to the metallic area MA is produced with high color saturation in the ink absorption layer PIK to the lower side of the metallic area MA. In FIG. 8C, the color reproduction area CA is depicted as reproducing color by uniform penetration to the lowermost face in the thickness direction of the ink absorption layer PIK; however, where smaller amounts of ink are used, it is not necessary for the ink to penetrate to the lowermost face, and a color reproduction by a concentration gradient of progressively higher density towards the surface is also acceptable.

Through the printing process described above, the printing system 10 of the present embodiment prints a metallic area with metallic ink and prints a color reproduction area with dye-based color ink of the color cyan (C), magenta (M), yellow (Y), or black (K) on a translucent printing medium P2 having an ink absorption layer PIK on the printing face thereof, doing so by carrying out printing of the metallic area and printing of the color reproduction area during the same main scan. Because printing of the metallic area and printing of the color reproduction area are carried out during the same main scan in this way, the time required for the printing process can be shorter. In the printing system 10, despite printing of the metallic area and printing of the color reproduction area being carried out during the same main scan, as shown in FIGS. 8A to 8C, through penetration of dye-based color ink into the ink absorption layer PIK, the color reproduction area CA is formed with high saturation to the lower layer side of the metallic area MA of metallic ink.

For this reason, when the printed result obtained on the translucent printing medium P2 with the printing system 10 of the present embodiment is viewed through the medium from the back face side of the ink-imprinted face, i.e., from the bottom side in FIGS. 8A to 8C (E2), the color reproduction area CA of dye-based color ink which has penetrated into the ink absorption layer PIK is seen to overlap the metallic area MA printed with metallic ink. The color reproduction area CA which overlaps the metallic area MA printed with metallic ink reproduces the color of the dye-based color ink with good saturation. Moreover, because the color ink of the color reproduction area CA is dye based and therefore highly translucent, the metallic effect of the metallic area MA situated at the lower layer side does not suffer. As a result, according to the printing system 10 of the present embodiment, it is possible both to preserve the metallic effect and to preserve the color saturation of color printing in an image that is printed using metallic ink and dye-based color ink concomitantly. Additionally, in the printed result obtained with the printing system 10 of the present embodiment, the translucent printing medium P2 has the function of protecting all of the printed areas including both the metallic area MA and the color reproduction area CA, thereby contributing to maintaining print quality.

Moreover, with the printing system 10 of the present embodiment, it is possible both to preserve the metallic effect and to preserve color saturation of color printing in an image that is printed using metallic ink and dye-based color ink jointly using the inkjet system printing method which enjoys widespread use as a printing method. Additionally, printed results can be easily obtained with the inkjet system printing method while maintaining the print quality.

D. MODIFIED EXAMPLES

It is to be understood that the embodiments described hereinabove are not limiting of the invention, and that various other modes are possible without departing from the scope of the invention, such as the following modifications for example.

Modified Example 1

In the preceding embodiments, printing with metallic ink is carried out by the printing system 10 which includes the computer 100 and the printer 200. However, optionally, the printer 200 itself may input image data from a digital camera or memory card of any of various formats, and print the image with metallic ink. That is, the CPU in the control circuit 260 of the printer 200 may carry out printing with metallic ink through execution of a process comparable to the printing process in the embodiments described above.

Modified Example 2

Whereas the preceding embodiments described an example in which the specialty gloss ink is metallic ink, pearlescent gloss inks containing pigments that have a pearlescent gloss effect once fixed onto the surface of a medium, for example, a pigment containing multiple stacked thin layers having pearl color like natural pearl, or lamé inks or translucent inks containing pigments that have microscopic irregularities so as to give rise to scattered reflection once fixed onto the surface of a medium to create a so-called lame or translucent effect, may be used in place of metallic ink.

Modified Example 3

Some of the functions accomplished through software in the preceding embodiments may instead be accomplished through hardware, or some of the functions accomplished through hardware may instead be accomplished through software.

Modified Example 4

Whereas the preceding embodiments described an example in which the dye-based color inks are inks of the four colors cyan, magenta, yellow, and black, other dye-based color inks may be used in addition to these four colors, such as light cyan and light magenta, green, orange, and so on.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A printing device comprising:

a print head having a specialty gloss ink ejection head for ejecting a specialty gloss ink creating a special gloss effect and a dye-based color ink ejection head for ejecting a dye-based color ink, the specialty gloss ink ejection head including a first nozzle and a second nozzle that are arrayed in a first direction of the print head, the dye-based color ink ejection head including a third nozzle and a fourth nozzle that are arrayed in the first direction, the first nozzle and the third nozzle being arranged in a second direction of the print head that is perpendicular to the first direction, the second nozzle and the fourth nozzle being arranged in the second direction; and an ejection control unit configured to carry out ejection of the specialty gloss ink from the specialty gloss ink ejection head in the second direction and ejection of the dye-based color ink from the dye-based color ink ejection head in the second direction, and to carry out printing of a special gloss area using the specialty gloss ink and printing of a reproduction area onto the special gloss area using the dye-based color ink, the ejection control unit having a first printing mode for carrying out printing of the reproduction area onto the special gloss area in a main scan in the second direction by using the fourth nozzle without using the third nozzle, which chronologically follows a main scan of the print head in which printing of the special gloss area is carried out in the second direction by using the first nozzle without using the second nozzle.

2. The printing device according to claim 1, wherein the ejection control unit further has a second printing mode whereby printing of the special gloss area by ejection of the specialty gloss ink from the specialty gloss ink ejection head and printing of the reproduction area by ejection of the dye-based color ink from the dye-based color ink ejection head are carried out simultaneously during one pass of the print head along a main scanning direction.

3. The printing device according to claim 1, wherein the specialty gloss ink is an effect-producing ink containing a pigment for producing a prescribed effect.

4. The printing device according to claim 1, wherein the specialty gloss ink is an ink having optical properties that are dependent on a reflection angle of the ink when printed onto a surface of a medium.

5. The printing device according to claim 3, wherein the specialty gloss ink is a metallic ink containing a pigment for producing a metallic effect.

6. A printing method comprising:

providing a print head having a specialty gloss ink ejection head for ejecting a specialty gloss ink creating a special gloss effect and a dye-based color ink ejection head for ejecting a dye-based color ink, the specialty gloss ink ejection head including a first nozzle and a second nozzle that are arrayed in a first direction of the print head, the dye-based color ink ejection head including a third nozzle and a fourth nozzle that are arrayed in the first direction, the first nozzle and the third nozzle being arranged in a second direction of the print head that is perpendicular to the first direction, the second nozzle and the fourth nozzle being arranged in the second direction; and carrying out ejection of the specialty gloss ink from the specialty gloss ink ejection head in the second direction and ejection of the dye-based color ink from the dye-based color ink ejection head in the second direction, and carrying out printing of a special gloss area using the specialty gloss ink and printing of a reproduction area onto the special gloss area using the dye-based color ink, the printing of the reproduction area onto the special gloss area being carried out in a main scan in the second direction by using the fourth nozzle without using the third nozzle that chronologically follows a main scan of the print head in which printing of the special gloss area is carried out in the second direction by using the first nozzle without using the second nozzle.

* * * * *